US009480865B2

(12) United States Patent
Naylor et al.

(10) Patent No.: US 9,480,865 B2
(45) Date of Patent: Nov. 1, 2016

(54) FALL ARREST SYSTEM

(71) Applicant: BMC, Boise, ID (US)

(72) Inventors: Dennis Naylor, Boise, ID (US); Rick Angus, Boise, ID (US)

( * ) Notice: Subject to any disclaimer, the term of this patent is extended or adjusted under 35 U.S.C. 154(b) by 147 days.

(21) Appl. No.: 13/800,711

(22) Filed: Mar. 13, 2013

(65) Prior Publication Data

US 2013/0240298 A1 Sep. 19, 2013

Related U.S. Application Data

(60) Provisional application No. 61/610,338, filed on Mar. 13, 2012.

(51) Int. Cl.

| | |
|---|---|
| ***A62B 35/00*** | (2006.01) |
| ***E04G 21/32*** | (2006.01) |
| *A63B 69/00* | (2006.01) |
| *A62B 1/08* | (2006.01) |

(52) U.S. Cl.

CPC ..... *A62B 35/00* (2013.01); *A62B 35/0056* (2013.01); *A62B 35/0075* (2013.01); *E04G 21/3276* (2013.01); *E04G 21/3295* (2013.01); *A62B 1/08* (2013.01); *A63B 69/0064* (2013.01)

(58) Field of Classification Search

CPC ..... A62B 35/00; A62B 35/0043; A62B 35/0056; A62B 35/0068; A62B 35/0075; A62B 35/0081; A62B 35/04; A62B 35/0093; A62B 35/0006; E04G 21/3219; E04G 21/3276; E04G 21/329; A63B 69/0064

USPC ..... 182/3, 231, 70, 73, 75, 236, 76, 191, 182/192

See application file for complete search history.

(56) References Cited

U.S. PATENT DOCUMENTS

| | | | | |
|---|---|---|---|---|
| 4,928,790 | A * | 5/1990 | Franks | 182/3 |
| 5,143,170 | A * | 9/1992 | Hunt et al. | 182/3 |
| 5,282,597 | A * | 2/1994 | Babcock | 248/237 |
| 5,287,944 | A * | 2/1994 | Woodyard | 182/3 |
| 5,433,044 | A * | 7/1995 | Walcher | A62B 35/0068 182/3 |
| 5,522,472 | A * | 6/1996 | Shuman et al. | 182/3 |
| 5,730,407 | A * | 3/1998 | Ostrobrod | 248/237 |
| 5,850,889 | A * | 12/1998 | Rexroad et al. | 182/3 |
| 5,975,239 | A * | 11/1999 | Castaneda | 182/45 |
| 6,092,623 | A * | 7/2000 | Collavino | 182/3 |
| 6,098,746 | A * | 8/2000 | Castaneda | 182/45 |
| 6,491,135 | B2 * | 12/2002 | Lee | 182/3 |
| 6,502,663 | B2 * | 1/2003 | Ecker et al. | 182/3 |
| 6,640,727 | B2 * | 11/2003 | Ostrobrod | 104/91 |
| 6,695,095 | B1 * | 2/2004 | Franke | 182/3 |

(Continued)

OTHER PUBLICATIONS

Definitions of 'is' and 'be' found in Action The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Daniel Cahn

(74) *Attorney, Agent, or Firm* — Shaver & Swanson, LLP; Robert L. Shaver

(57) ABSTRACT

A fall arrest system adapted for use in construction projects with wall studs of various spacing. The fall arrest system comprises a wall attachment bracket and a retractable harness line system, which provides extension, retraction, and storage of a harness line. The harness line is connected to a user-worn harness to protect the user from falling.

7 Claims, 3 Drawing Sheets

(56) References Cited

U.S. PATENT DOCUMENTS

| | | | | |
|---|---|---|---|---|
| 6,776,259 | B1 * | 8/2004 | Murten | 182/3 |
| 6,779,629 | B2 * | 8/2004 | Ecker et al. | 182/3 |
| 6,779,630 | B2 * | 8/2004 | Choate | 182/36 |
| 7,048,090 | B2 * | 5/2006 | Dean et al. | 182/3 |
| 7,357,222 | B2 * | 4/2008 | Durbic | 182/3 |
| 7,530,626 | B2 * | 5/2009 | Rohatinovici | 296/184.1 |
| 8,616,332 | B2 * | 12/2013 | Witlam et al. | 182/3 |
| 8,627,923 | B2 * | 1/2014 | Sidla et al. | 182/3 |
| 2001/0032435 | A1 * | 10/2001 | Austin | 52/749.12 |
| 2002/0079164 | A1 * | 6/2002 | Choate | 182/36 |
| 2003/0159883 | A1 * | 8/2003 | Carson | 182/113 |
| 2004/0055818 | A1 * | 3/2004 | Fulton et al. | 182/3 |
| 2005/0098381 | A1 * | 5/2005 | Flaherty | 182/3 |
| 2005/0145435 | A1 * | 7/2005 | Choate | 182/3 |
| 2005/0269153 | A1 * | 12/2005 | Casebolt | 182/3 |
| 2006/0163002 | A1 * | 7/2006 | Langsmead | 182/113 |
| 2007/0144830 | A1 * | 6/2007 | Mastenbroek | 182/3 |
| 2007/0205047 | A1 * | 9/2007 | Vetesnik | 182/3 |
| 2008/0035423 | A1 * | 2/2008 | Meillet et al. | 182/3 |
| 2008/0041660 | A1 * | 2/2008 | Marini | 182/3 |
| 2008/0139326 | A1 * | 6/2008 | Lickle | 472/92 |
| 2008/0202849 | A1 * | 8/2008 | Russo et al. | 182/3 |
| 2009/0223744 | A1 * | 9/2009 | Dowie | 182/234 |
| 2011/0073408 | A1 * | 3/2011 | Vetesnik | 182/3 |
| 2011/0198152 | A1 * | 8/2011 | Dowie | 182/3 |

OTHER PUBLICATIONS

Pictures of houses with vertical studs/cross beams in Action from goole search below: https://www.google.com/search?q=studs+for+a+house&rls=com.microsoft:en-us:IE-Address&source=lnms&tbm=isch&sa=X&ei=Yp7aU4z1MunnsATx1YDwCw&ved=0CAkQ_AUoAg&biw=1396&bih=908.*

* cited by examiner

FALL ARREST SYSTEM

PRIORITY/CROSS-REFERENCE TO RELATED APPLICATIONS

This application claims the benefit of U.S. Provisional Application No. 61/610,338, filed Mar. 13, 2012, the disclosure of which is incorporated by reference.

BACKGROUND

The disclosure generally relates to a system for use by a worker on a building construction project. The system protects against falls and is adapted for use with a variety of construction environments. Particular embodiments relate to applications involving residential or commercial building construction projects with wall support members spaced one or more feet apart.

Construction workers are often exposed to potential falling hazards where one wrong step could send them plummeting to a career- or life-ending injury. Harness systems are frequently used in construction settings, but there is a need for a harness that is readily adaptable to use with multiple wall support members—or "studs"—and for use with a variety of spacing. Stud spacing varies with vintages and regions of construction, but the need for a sturdy harness anchor is constant. Furthermore, there is a need for a harness system that gives a user an appropriate amount of harness line slack so the he or she can move freely, but a slack harness line creates its own problem because it allows a user to fall a distance equal to the slack in the line before breaking his or her fall. The disclosed system provides a means for securely anchoring a harness to multiple studs in a variety of stud configurations. It also provides a means for paying out and retracting harness line to a user-worn harness in proportion to the user's distance from the anchors.

BRIEF SUMMARY

The disclosed technology is a fall arrest system that might typically be used on the interior of a building, such as the interior of a residential or commercial building that is under construction. The fall arrest system could also be used on the exterior of a building, e.g., by workers on roofs, near or on gutters, or for exterior walls and trim. The disclosed system is adaptable for use with vertical wall support framing members, or studs, which typically comprise dimensional lumber having a cross section of two inches by four inches (2"×4") or two inches by six inches (2"×6"). The system is also capable of use in building construction involving steel studs.

The system includes at least one wall attachment bracket that is anchored to a wall, such as an interior wall, by screws or bolts. The wall attachment bracket is a generally rectangular member with a central wall anchor point, and left and right wall anchor points. The left and right anchor points are attached to the bracket in a way that allows them to slide on the bracket to align with wall studs of various spacing.

The system also includes a harness line reel, which provides for an extendable and retractable harness line, which, in turn, attaches to a user-worn harness. The harness line reel is attached to the wall attachment bracket, either directly or via a support line. The harness line reel feeds out the harness line, allowing the user enough slack to move about, unless and until the harness line is withdrawn too quickly, such as when a user falls. In that case, the harness line reel seizes and halts further withdrawal of the harness line. The harness line reel also retracts the harness line when the user moves closer to the reel. The system typically has two wall attachment brackets, which are connected by a support line. The reel is attached to the support line, and is free to move along the support line, giving the user freedom to move along the support line, and also at a certain distance from the support line.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the disclosed concept(s) are capable of modification in various obvious respects. Accordingly, the drawings and descriptions herein are to be regarded as illustrative in nature and not as restrictive in nature.

DETAILED DESCRIPTION

Figure 1:
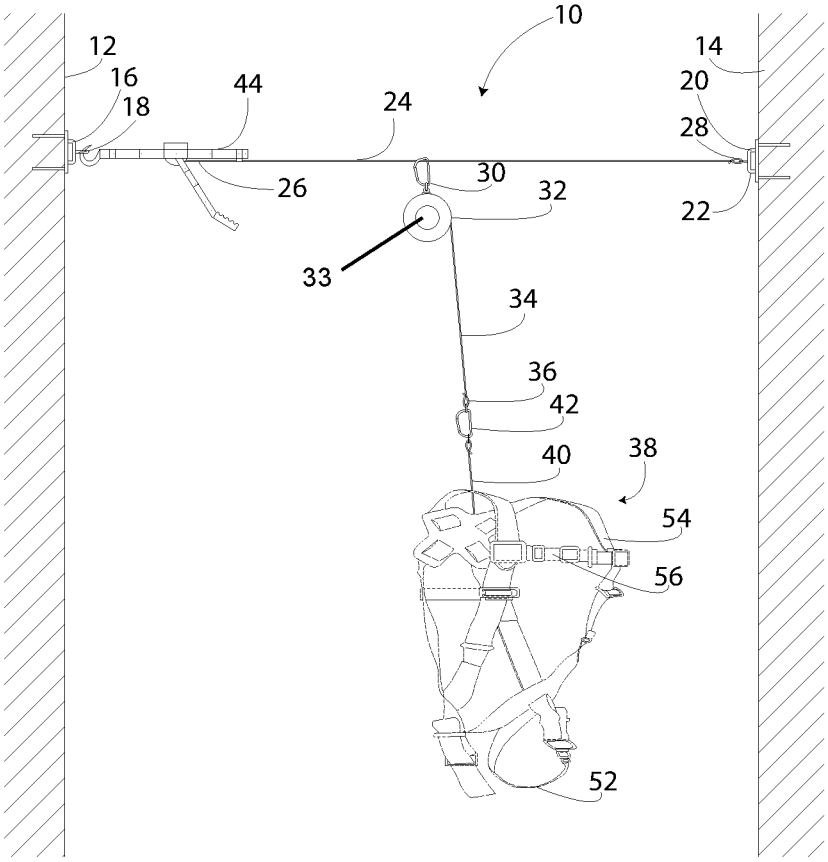
FIG. 1 is a perspective view of an embodiment of the disclosed system wherein multiple wall attachment brackets are employed.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) are to cover all modifications, alternative constructions, and equivalents falling within the spirit and scope of the inventive concept(s) as defined in the claims.

FIG. 1 shows fall arrest system 10, which is a harness system to prevent a worker from falling, for example, while working on a construction site. Fall arrest system 10 is connected between a first wall 12 and a second wall 14. A first wall attachment bracket 16, which comprises a first attachment point 18, is attached to the first wall 12. A second wall attachment bracket 20, which comprises a second attachment point 22, is attached to the second wall 14. Attachment is typically by screw, bolt, or other commonly used fastening means. Spanning the space between the first wall attachment bracket 16 and the second wall attachment bracket 20 is a support line 24. The support line 24 could be made of flat webbing, rope, cable, or other similarly supportive material. The support line 24 could be attached to the attachment points 18, 22 by knots and hooks, a carabiner, a loop of line through a ring, or other conventional mechanical means of attaching a rope to an anchor device. The installation could also include a device that allows the support line to extend out from the wall attachment bracket and stop a fall, but allow a certain amount of descending. This could be a friction-inducing system commonly found in repelling devices and other safety harnesses. The wall attachment brackets 16, 20, would typically be mounted on walls 12 and 14 at a height of about six (6) to seven (7) feet above a work surface, such as the upper floor of a building, when work is done around an open stairwell or balcony.

The support line 24 has a first end 26 and a second end 28. The first end 26 is attached to the first wall attachment bracket 16 at the first attachment point 18. The second end 28 of the support line 24 is attached to the second wall attachment bracket 20 at the second attachment point 22. Slideably attached to the support line 24, via a slideable attachment means 30, is a harness line reel 32. The slideable attachment means could be a carabiner, pulley, or other low-friction device that allows the harness line 32 to readily move along the length of the support line 24.

The harness line reel 32 comprises a retractable reel for storage of a harness line 34 and provides for retraction and extension of the harness line 34 as needed. The retractable reel includes a speed brake 33 which locks the reel then the speed of line retraction exceeds a certain rate. A speed brake is a braking mechanism that freely allows line to be payed out of the harness line reel 32 until the speed of withdrawal of the harness line 34 exceeds a certain maximum, at which time the speed brake locks, stopping the outflow of the harness line 34. This is similar to the seatbelt retractors found in automobile seatbelt assemblies, which allow the seatbelt to be pulled out as needed, but which are sensitive to the speed at which the seatbelt material is pulled out of the reel.

The end of the harness line 34 furthest from harness line reel 32 is referred to here as the first end 36 of the harness line 34. The first end 36 of harness line 34 is attached to a harness lead 40 via a harness attachment 42. The harness attachment 42 could be a carabiner, a D-ring, or any other suitable attachment mechanism. The harness lead 40 is attached to the harness 38, which is worn by a worker for support by the fall arrest system 10. The harness 38 can be made in any number of configurations—from a simple belt around a person's waist, to a belt which includes leg loops 52, to a harness that includes leg loops 52, shoulder straps 54, and a chest strap 56. The harness lead 40 can likewise be made from a variety of materials, such as a woven cloth material, like one would find in a seat belt; or it could be steel cable, braided cord or rope, or any other material with suitable strength to hold the fall of a worker and any equipment the worker may be carrying.

The fall arrest system 10 may be equipped with a support line tensioner 44, as is demonstrated in FIG. 1. The support line tensioner could be any number of rope tensioning and/or securing devices, such as: a strap or a webbing ratchet (aka a "come along"), a camming rope-locking device, a rope ascender or repelling device (like one might see in climbing sports), or other commonly used mechanical devices. Any of these devices would serve to take up slack in the support line 24, and keep the line essentially taut, thus reducing the distance a user would fall when attached to the fall arrest system 10.

The essential components of the system can be arranged is different configurations than that shown as preferred. The retracting reel can be attached to a wall attachment, to the user harness, or can be free floating on the support line, as shown.

The materials and dimensions of the parts of the system can vary according to the specific job site, but some typical dimensions for certain job sites are listed below. In an exemplary configuration, the support line could be 15 to 20 feet, the wall attachment brackets could be 42 inches long, and 3 inches wide. The harness line could be three feet long, of 0.25 inch webbing, and the retracting reel could hold 20 feet of harness line.

Figure 2:
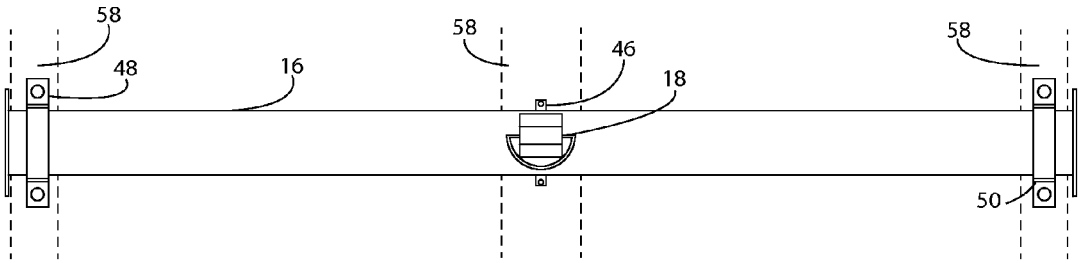
FIG. 2 is a front view of the disclosed wall attachment bracket.
Figure 2A:
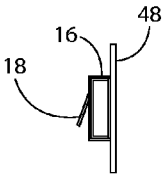
FIG. 2A is a side view of the disclosed wall attachment bracket.

FIGS. 2 and 2A show details of the wall attachment bracket—for reference purposes, the first wall attachment bracket 16 is referred to, but the second wall attachment bracket 20 is identical. The fall arrest system 10 includes one or more wall attachment brackets, of the type like the first wall attachment bracket 16, which are anchored to a wall, such as an interior wall of a building that is under construction, by screws, bolts, or other commonly used fastening means. In the preferred embodiment, the wall attachment bracket 16 is equipped with a center wall anchor point 46, a left wall anchor point 48, and a right wall anchor point 50. The center wall anchor point 46 could be one or more holes in the wall attachment bracket 16, with the bracket 16 being a piece of steel that is one to three inches wide and approximately four feet long. The center wall anchor point 46 could be anchored to a wall by a bolt passing through a hole or holes in the center wall anchor point 46. The center wall anchor point 46 could also include an additional bracket section, which is generally normal to the wall attachment bracket 16 with holes through which a bolt could be passed and connected to an underlying wall stud 58.

The wall attachment bracket 16 also includes a left anchor point 48 and a right anchor point 50. As discussed infra, more anchor points are also within the scope of this disclosure. The left anchor point 48 and right anchor point 50 are attached to wall attachment bracket 16 in a manner that allows them to slide on the wall attachment bracket 16 to align with underlying wall studs 58. The left wall anchor point 48 and right wall anchor point 50 can be brackets that extend above and below wall attachment bracket 16, with the anchor points having holes through which a bolt or screw can pass and attach to a wall stud 58. The purpose of the left wall anchor point 48 and the right wall anchor point 50 is to allow a user to slide each anchor point so that it can be positioned over a wall stud 58. In this way, the wall attachment bracket 16 can be firmly attached to multiple studs 58, thus providing more strength for the fall arrest system 10 to resist the lateral pull a support line 24 and the weight of a user of the system 10, if the user fell.

In other embodiments, the wall attachment bracket 16 has fewer than three anchor points or more than three anchor points. In all embodiments, at least one anchor point is capable of slidable adjustment along the length of the wall bracket 16 so that a user may align the anchor points with an underlying wall stud.

In a scenario where a user encounters wall studs 58 that are on fourteen-inch centers, the user could position the center wall anchor point 46 over one stud 58 and adjust the left wall anchor point 48 and the right wall anchor point 50 to be each fourteen inches away from center wall anchor point 46, thereby allowing the user to bolt each of the three anchor points to a separate stud 58. Likewise, if a user encounters wall studs 58 on sixteen-inch centers, the user may attach the center wall anchor point 46 to one stud 58 and adjust the left wall anchor point 48 and right wall anchor point 50 sixteen inches off center.

FIG. 2 depicts an embodiment of the wall attachment bracket 16 for use with three studs 58. It is, however, within the concept of the disclosure for more than three studs to be utilized as anchor points. In such an embodiment, the wall attachment bracket 16 would be longer and have more attachment brackets and more sliding anchor points so that a user may slide each anchor point to align with a stud.

The left wall anchor point 48 and right wall anchor point 50 would typically be made of steel and be approximately five inches long, with an upper and lower bracket that projects beyond (i.e., above and below) the wall attachment bracket 16 with a passage hole for a bolt or screw above and below wall attachment bracket 16. A typical means of securing each of the wall anchor points 46, 48, 50 to wooden studs is with two-and-one-half-inch by one-quarter-inch (2½"×¼") lag screws, with two screws per wall anchor point. The wall attachment bracket 16 is suitable for attachment to walls covered by a variety of construction materials including gypsum board (aka, sheetrock), siding, or other materials.

Figure 3:
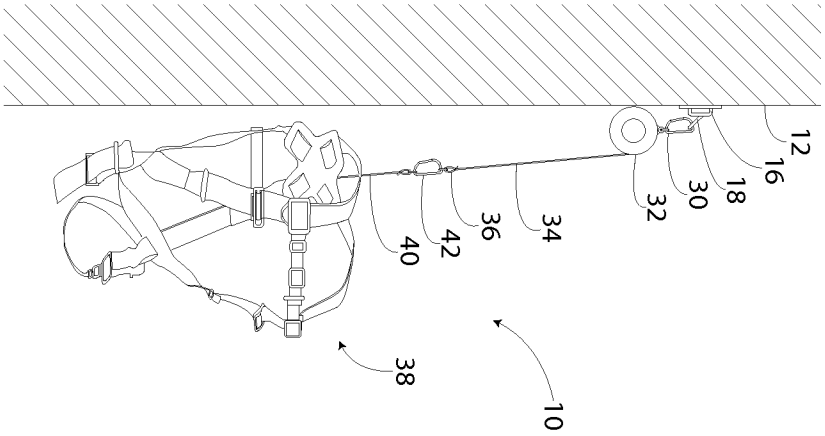
FIG. 3 is a perspective view of an embodiment of the disclosed system wherein a single wall attachment bracket is employed.

FIG. 3 shows an embodiment of the fall arrest system 10 in which a single wall attachment bracket is employed. Attached to the first wall 12 is a first wall attachment bracket 16, which comprises a first attachment point 18. In this embodiment, the harness line reel 32 is attached directly to the first attachment point 18 via an attachment means 30, which could comprise a carabiner, a knot, hook, or other conventional mechanical means of attaching a rope to an anchor device. As with previously discussed embodiments, the harness line 34, which is payed out of the harness line reel 32, is attached to the harness 38 via at the first end 36 of the harness line 34. This embodiment dispenses with the need for a support line 24 and line tensioner 44, as well as a second wall attachment bracket 20.

Alternatively, the harness line reel 32 could be attached directly to, or integrated into the harness 38. In such an embodiment, the first end 36 of the harness line 34 would be attached to attachment point 18 or to the slideable attachment means 30. Such an embodiment could dispense with the need for a harness lead 40. In yet another embodiment, the harness line reel 32 could allow the harness line to be fed in two directions, and thus retracting the harness line from either end toward the middle.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A fall arrest system comprising:

a first wall attachment bracket with a center wall anchor point, and further comprising a left and a right wall anchor point slideably attached to said first wall attachment bracket, each of the anchor points of the first wall attachment bracket configured to be anchored to a first wall by a bolt passing through at least one hole to allow for attachment to a first set of vertical wall studs with varying spacing between said first set of vertical wall studs, with said first wall attachment bracket configured for horizontal placement across said first set of vertical wall studs in a building, said first wall attachment bracket further comprising at least one line attachment point;

a second wall attachment bracket with a center wall anchor point, and further comprising a left and a right wall anchor point slideably attached to said second wall attachment bracket, each of the anchor points of the second wall attachment bracket configured to be anchored to a second wall by a bolt passing through at least one hole to allow for attachment to a second set of vertical wall studs with varying spacing between said second set of vertical wall studs, with said second wall attachment bracket configured for horizontal placement across said second set of vertical wall studs on the second wall positioned opposite to said first wall which said first wall attachment bracket is attached, said second wall attachment bracket further comprising at least one line attachment point;

a support line with a first end and a second end respectively configured to attach to said line attachment points on said first and second wall attachment brackets;

a harness configured for wear by a user of said system;

a harness line reel comprising a speed brake and a harness line with a first end attachable to said harness, the harness line reel configured to slideably attach to said support line, said harness line reel configured to store the harness line on said reel and feed out said harness line from said reel, and the speed brake being configured to stop said feed out of the harness line as a result of a maximum speed of said feed out being sensed;

said system configured to provide fall protection to said user wearing said harness by braking said feed out of said harness line when the maximum speed of said feed out of the harness line is reached as a result of a fall of said user.

2. The fall arrest system of claim 1 which further comprises a support line tensioner for adjusting an outfeed line tension of said support line between said wall attachment brackets.

3. The fall arrest system of claim 1 in which said support line is comprised of flat webbing.

4. The fall arrest system of claim 1 in which said first and second wall attachment brackets are generally rectangular and elongate steel bars.

5. The fall arrest system of claim 1 in which said harness comprises a belt.

6. The fall arrest system of claim 5 in which said harness further comprises leg loops.

7. The fall arrest system of claim 6 in which said harness further comprises a chest harness.

* * * * *